US010639241B1

(12) United States Patent
Torres et al.

(10) Patent No.: US 10,639,241 B1
(45) Date of Patent: May 5, 2020

(54) DISH WASHABLE TEETHING SHOE

(71) Applicants: Andres Torres, Miami Springs, FL (US); Veronica Parra, Miami Springs, FL (US)

(72) Inventors: Andres Torres, Miami Springs, FL (US); Veronica Parra, Miami Springs, FL (US)

( * ) Notice: Subject to any disclaimer, the term of this patent is extended or adjusted under 35 U.S.C. 154(b) by 0 days.

(21) Appl. No.: 16/789,610

(22) Filed: Feb. 13, 2020

(51) Int. Cl.

| | |
|---|---|
| ***A43B 3/30*** | (2006.01) |
| ***A61J 17/00*** | (2006.01) |
| ***A43B 3/00*** | (2006.01) |
| ***A43B 1/10*** | (2006.01) |
| ***A43B 11/00*** | (2006.01) |

(52) U.S. Cl.
CPC ..... *A61J 17/00* (2013.01); *A43B 1/10* (2013.01); *A43B 3/0036* (2013.01); *A43B 3/30* (2013.01); *A43B 11/00* (2013.01)

(58) Field of Classification Search
CPC ... A43B 3/28; A43B 3/30; A43B 23/24; A61J 17/02
USPC ..... 36/90, 112
See application file for complete search history.

(56) References Cited

U.S. PATENT DOCUMENTS

| | | | | | |
|---|---|---|---|---|---|
| 2,677,903 | A * | 5/1954 | Gaquin | A43B 3/30 | 36/105 |
| 2,730,818 | A * | 1/1956 | Prospe | A43B 3/30 | 36/105 |
| 2,745,196 | A * | 5/1956 | Schneider | A43B 3/14 | 36/97 |
| 3,058,241 | A * | 10/1962 | Rigsby | A43B 3/30 | 36/97 |
| 3,134,179 | A * | 5/1964 | Laham | A43C 1/00 | 36/112 |
| 3,463,163 | A * | 8/1969 | Matles | A61F 5/0193 | 36/142 |
| 3,681,860 | A * | 8/1972 | Bidegain | A43B 1/0054 | 36/112 |
| 6,405,458 | B1 * | 6/2002 | Fleshman | A43B 3/30 | 36/103 |
| 2009/0272010 | A1 * | 11/2009 | Loverin | A43B 3/30 | 36/112 |
| 2011/0167675 | A1 * | 7/2011 | Matalon | A43B 3/30 | 36/112 |
| 2014/0135836 | A1 * | 5/2014 | Beavers | A61J 17/02 | 606/235 |
| 2018/0055741 | A1 * | 3/2018 | Hyslop | A41D 19/0024 | |
| 2019/0216682 | A1 * | 7/2019 | Vreeland | A61H 39/04 | |

* cited by examiner

*Primary Examiner* — Marie D Bays
(74) *Attorney, Agent, or Firm* — Ruben Alcoba, Esq.

(57) ABSTRACT

A dish washable teething shoe for infants. The teething shoe is made of a food grade silicone rubber. The teething shoe defines a flat appendage that extends outward from front section of the shoe. The flat appendage shall extend outward from the front outsole of the shoe and the appendage shall follow the curvature of the front section of the shoe. The top and bottom sections of the flat appendage define a plurality of protuberances.

4 Claims, 3 Drawing Sheets

DISH WASHABLE TEETHING SHOE

TECHNICAL FIELD

The present invention pertains to dish washable teething shoe for infants.

BACKGROUND

The inventors of the present invention are the parents of a teething infant.

The teething infant loved to place her footwear in her mouth to cut his teeth.

The parents did not like the infant's habit, for it did not seem very sanitary.

The parents searched for a teething device that could be placed on their infant's feet, yet they were not able to find a suitable teething device. They believed that the teething device had to resemble a shoe and that the teething device had to be dish washable.

The present invention provides a dish washable teething shoe that will allow an infant to cut his teeth.

SUMMARY

The present invention is directed to a dish washable teething shoe for infants.

The teething shoe is made of a food grade silicone rubber. The teething shoe defines a flat appendage that extends outward from front section of the shoe. The flat appendage shall extend outward from the front outsole of the shoe and the appendage shall follow the curvature of the front section of the shoe.

The flat appendage extends outward a distance of at least half an inch from a front section of the outsole of the shoe. The top and the bottom sections of the flat appendage define a plurality of protuberances that allow an infant to cut his or her teeth.

An object of the present invention is to provide an infant shoe that allows an infant to cut his or her teeth.

Another object of the present invention is to provide a teething shoe that is dish washable.

DRAWINGS

These and other features, aspects, and advantages of the present invention will become better understood with regards to the following description, appended claims, and drawings where:

DESCRIPTION

Figure 1:
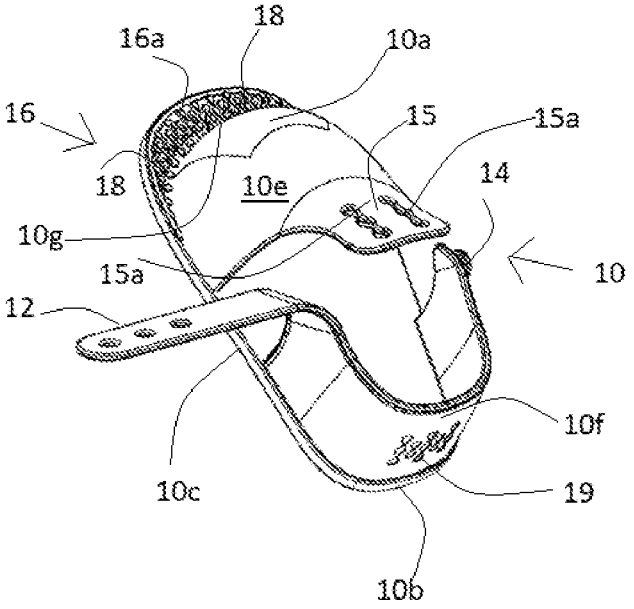
FIG. 1 is a perspective view of the present invention that shows the top of a dish washable teething shoe.
Figure 2:
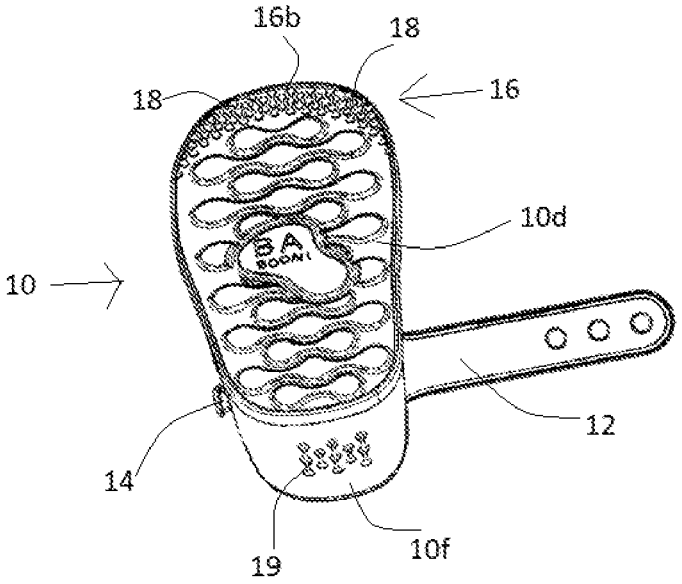
FIG. 2 is a perspective view of the present invention that shows the bottom of the dish washable teething shoe.
Figure 3:
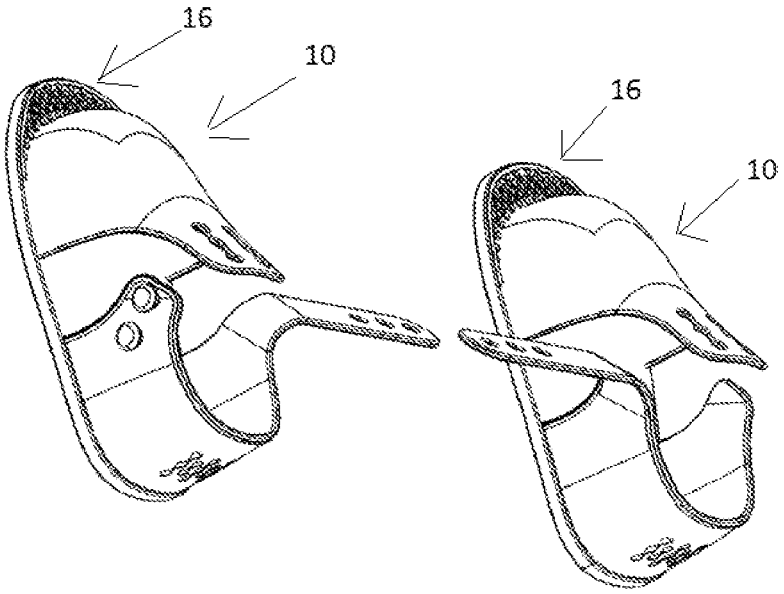
FIG. 3 is a perspective view of the present invention that shows a pair of dish washable teething shoes.

Referring to FIGS. 1-3, the present invention is a dish washable teething shoe 100 for infants.

The dish washable teething shoe comprises of a food grade silicone rubber shoe 10 that has a front section 10*a*, a rear section 10*b* and a middle section 10*c*, the shoe 10 has an outsole 10*d*, the front section 10*a* defines a toe cap 10*e*, the middle section 10*c* defines a strap 12 and a strap receiver 14, and the rear section 10*b* defines a heel support 10*f*, a flat appendage 16 extends outward from a front section 10*g* of the outsole 10*d* of the shoe 10 and the flat appendage 16 follows a curvature of the front section 10*a* of the shoe 10, the flat appendage 16 has a top section 16*a* and a bottom section 16*b*.

In preferred embodiments of the present invention, a plurality of protuberances 18 extend outward from the top 16*a* and bottom 16*b* sections of the flat appendage 16 and the flat appendage extends outward a distance of at least half an inch from the front section 10*g* of the outsole 10*d* of the shoe 10.

In an embodiment of the present invention, the heel support 10*f* defines a plurality of apertures 19.

In another embodiment of the present invention, the shoe 10 defines a tongue 15 that extends from the toe cap 10*e* and the tongue 15 defines a pair of strap guides 15*a*. The two strap guides 15*a* allows a parent to pass the strap 12 through the two strap guides 15*a* prior to securing the strap 12 to the strap receiver 14.

An advantage of the present invention is that it provides an infant shoe that allows an infant to cut his or her teeth.

Another advantage of the present invention is that it provides a teething shoe that is dish washable.

The embodiments of the teething shoe described herein are exemplary and numerous modifications, combinations, variations, and rearrangements can be readily envisioned to achieve an equivalent result, all of which are intended to be embraced within the scope of the appended claims. Further, nothing in the above-provided discussions of the teething shoe should be construed as limiting the invention to an embodiment or a combination of embodiments. The scope of the invention is defined by the appended claims.

What is claimed is:

1. A teething shoe for infants, the teething shoe comprises: a food grade silicone rubber shoe that has a front section, a rear section and a middle section, the shoe has an outsole, the front section defines a toe cap, the middle section defines a strap and a strap receiver, and the rear section defines a heel support, a flat appendage extends outward from a front section of the outsole of the shoe and the flat appendage follows a curvature of the front section of the shoe, the flat appendage has a top section and a bottom section.

2. The teething shoe for infants of claim 1, the teething shoe comprises of a plurality of protuberances that extend outward from the top and bottom sections of the flat appendage and the flat appendage extends outward a distance of at least a half an inch from the front section of the outsole of the shoe.

3. The teething shoe for infants of claim 2, wherein the heel support defines a plurality of apertures.

4. The teething shoe for infants of claim 3, wherein the shoe defines a tongue that extends from the toe cap and the tongue defines a pair of strap guides.

* * * * *